United States Patent [19]

Meckel et al.

[11] 4,203,803

[45] May 20, 1980

[54] CHARGING OF COKE OVENS WITH PREHEATED COAL

[75] Inventors: Joachim F. Meckel, Heiligenhaus; Wolfgang Rohde, Essen; Werner Siebert, Essen; Dietrich Wagener, Essen; Claus Flockenhaus, Essen; Manfred Galow, Essen, all of Fed. Rep. of Germany

[73] Assignees: Bergwerksverband GmbH; Didier Engineering GmbH, both of Essen, Fed. Rep. of Germany

[21] Appl. No.: 935,107

[22] Filed: Aug. 21, 1978

[30] Foreign Application Priority Data

Aug. 24, 1977 [DE] Fed. Rep. of Germany ..... 2738094

[51] Int. Cl.[2] ..... C10B 31/04

[52] U.S. Cl. ..... 201/40; 201/41; 201/18; 202/262

[58] Field of Search ..... 201/18, 40, 41; 202/262; 214/18 R, 18 PH, 35 R

[56] References Cited

U.S. PATENT DOCUMENTS

| | | | |
|---|---|---|---|
| 1,886,948 | 11/1932 | Folsom | 201/40 |
| 3,047,473 | 7/1962 | Schmidt | 201/40 X |
| 3,415,504 | 12/1968 | Smith et al. | 214/35 |
| 3,432,398 | 3/1969 | Schmidt | 201/40 X |
| 3,457,141 | 7/1969 | Schmidt | 201/40 X |
| 3,761,360 | 9/1973 | Auvil et al. | 201/40 |
| 3,877,686 | 4/1975 | Leonidor et al. | 214/35 R X |
| 4,060,458 | 11/1977 | Davis, Jr. | 201/40 |

*Primary Examiner*—Michael S. Marcus
*Attorney, Agent, or Firm*—Michael J. Striker

[57] ABSTRACT

Method for charging a coke oven chamber. Where the chamber is charged through a single charging hole with a stream of flowable preheated particulate coal at a flow rate of between substantially 8-20 tons per minute. The coal flows sufficiently in the chamber to assure filling of the chamber to substantially 100% of the volumetric capacity of the same. Due to the flowability of the preheated coal the charge is self-leveling.

2 Claims, 3 Drawing Figures

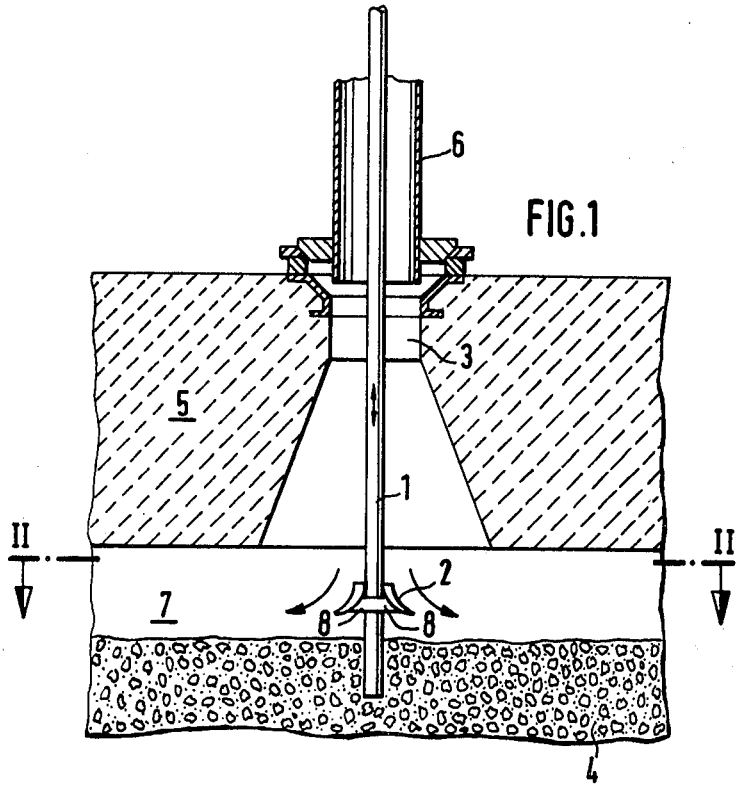
FIG.1
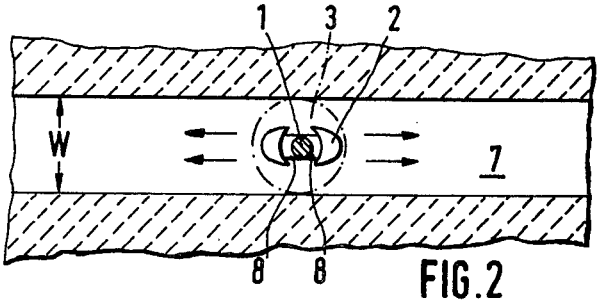
FIG.2
FIG.3
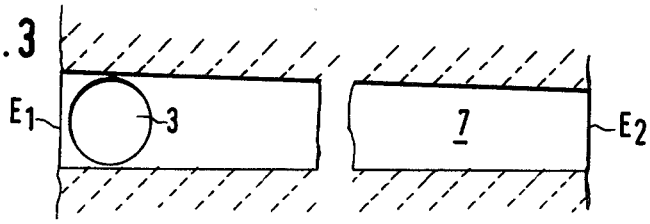

CHARGING OF COKE OVENS WITH PREHEATED COAL

BACKGROUND OF THE INVENTION

1. Field of the Invention

The present invention relates to the charging of coke ovens with coal.

More particularly, the invention relates to the charging of preheated coal into coke ovens.

Still more specifically, the present invention relates to a method of charging coke ovens with preheated coal, and to an apparatus for carrying out the method.

2. The Prior Art

Coke is made by charging particulate coal, usually a mixture of high-volatile and low-volatile coals, into coking ovens wherein the coal is then converted into coke by destructive distillation. The coal charge is admitted through charging holes in the ceiling of the coke ovens by means of suitable devices.

The number of charging holes and the physical characteristics of the coal have a definite bearing on the time required for charging the oven with the coal. A minimum charging time is particularly desired for many reasons ("The Making, Shaping and Treating of Steel," United States Steel Corporation, 8th Ed., p. 107).

Conventionally the coal is charged into coke ovens as wet coal. This is charged into the oven at the conventionally accepted rate of about 4–6 t/min and forms hills and valleys in the oven chambers; the charge must therefore, on completion of its admission, be leveled. Depending upon the characteristics of the coal and/or its moisture content, a substantial amount of such leveling may be required. This is time-consuming. Furthermore, excessive leveling tends to pack the coal along the top of the coal charge, particularly under the charging holes, thus increasing the bulk density and heat requirements in this area. Excessive leveling may also cause local erosion of the oven wall (ibid).

During the past decade it has been proposed to preheat the particulate coal before charging it into the coke oven. This proposal achieves a remarkable improvement in the coke oven efficiency and the quality of coke produced, even when lower-quality coking coal is utilized for the charge in view of the continuously decreasing world-wide availability of high-quality coal.

From the oven-charging viewpoint, the use of preheated coking coal provides still another advantage. The flow properties of preheated particulate coal differ substantially from those of wet coal, since the adhesion forces between the individual coal particles are much lower than is the case with wet coal. This has made it possible to fill coke oven chambers via only two filling holes at the conventional 4–6 t/min charging rate and yet to achieve a relatively uniform charging of the chamber to a high level without requiring subsequent leveling of the charge, since due to its good flow properties the preheated coal charge tends to level itself.

However, as already indicated, a minimum charging time is one of the very important aspects of coke oven operation, not only in terms of operating economy but also in view of the reduction in environmental pollution attendant upon every charge-time reduction. Further reductions in the required charging time, and improvements in the uniformity of charging and in the utilization of the chamber volume, are therefore desirable.

SUMMARY OF THE INVENTION

Accordingly, it is an object of the invention to provide such improvements.

More particularly, it is an object of the invention to reduce the time required for charging a coke oven with preheated coal.

Another object is to improve the uniformity of filling of the oven chamber and to assure complete utilization of the available chamber volume.

A further object is to provide a method of charging a coke oven with preheated coal, which method achieves the above objects.

A concomitant object is to provide an improved apparatus for carrying out the method.

In keeping with the objects, and with still others which will become apparent hereafter, one aspect of the invention resides in a method of charging a coke oven chamber. Briefly stated, this method comprises the steps of providing the top of the chamber with a single charging hole, and charging the chamber by admitting through the charging hole a stream of preheated particulate coal at a charging rate of substantially 8–20 t/min whereby, due to the flowability of the preheated coal particles, the chamber becomes charged to its permissible filling level at substantially 100% of its volumetric capacity.

By resorting to the invention it is possible to fill the chamber uniformly to its upper permissible level by admitting the preheated coal through a single charging hole. This is a surprising result, since it was heretofore accepted that filling through two charging holes would be needed to obtain these results at the filling rate of 4–6 t/min; charging through a single hole was found to be impossible if the above requirements were to be met. However, according to the invention it has been found that by charging at the invention rate of 8–20 t/min the coal entering the chamber flows so strongly in all directions in the chamber that rapid, complete, uniform filling of the chamber to the desired level is assured even though filling is effected through only a single charging hole.

Another surprising factor is that when an oven chamber is charged in accordance with the invention, fewer coal particles are expelled into the gas off-take main than is the case when the chamber is charged through two holes and at the conventional 4–6 t/min flow rate. In fact, one of the main reasons why the industry had settled on a charging rate of 4–6 t/min was the belief that any increase in the charging rate would result in a drastic step-up of coal particle expulsion into the take-off main with the resulting unpleasant consequences, such as atmospheric contamination, danger of explosion and the like. The experiments made in the course of the present invention show that this problem does not in fact occur, although it is not fully understood why this should be so.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 1 is a fragmentary diagrammatic vertical section through the upper part of a coke oven, showing a charging hole and an apparatus according to the invention;

FIG. 2 is a section taken on line II—II of FIG. 1; and

FIG. 3 is a view similar to FIG. 2, but looking upwardly towards the oven ceiling and illustrating another embodiment.

DESCRIPTION OF THE PREFERRED EMBODIMENTS

The novel method and the apparatus for carrying it out will hereafter be described with reference to the exemplary embodiment shown in FIGS. 1 and 2.

These Figures show a portion of the ceiling 5 of a coking oven, which ceiling is provided with a charging hole 3. The charging hole diverges conically in downward direction, i.e. towards the oven chamber 7 in which the process is carried out.

The preheated coal is transported to the charging hole 3 via a (not illustrated) drag-chain conveyor or the like (mounted in conventional manner above the oven ceiling) which communicates with the charging hole by means of a charging chute or tube 6.

The coal is advanced by the conveyor, and admitted through the charging hole 3 into the oven chamber 7, at a charging rate of substantially 8–20 t/min so that as it rushes into the chamber 7 through the hole 3 (which must of course be large enough to permit the required rate of flow of gravity-fed coal, as a general rule it is advantageous if the single hole has a diameter of between substantially 300 and 500 mm which corresponds to the standard chamber width W, as shown in FIG. 2), so as to fill the chamber 7 to the upper permissible level (shown in FIG. 1) and for the charge to level itself due to the flow characteristics of the preheated coal.

A rod 1 is extendable (in a manner known per se) from above through the chute 6 and hole 3 into the chamber 3. This may either be a separate rod provided for the purposes of the invention, or use may be made of the similar rod of a conventionally employed filling-level indicator. In either case the rod 1 will carry, according to the invention, a deflector member 2 which is of generally plow-share shaped cross-section and is located in the chamber 7 above the upper permissible filling level of the same. The member 2 is so positioned that it will be impinged by a relatively small portion of the incoming coal stream (not shown). To this portion of the stream the member 2 imparts a deflection in direction lengthwise of the chamber (i.e. to the left and right in FIG. 2); since the (single) charging hole 3 is located about midway between the two chamber ends, the deflection of the coal takes place symmetrically along the chamber axis, with reference to the two chamber ends. In other words: the dimensioning and positioning of the member 2 with reference to the dimensioning of the filling hole 3, and its downward spacing from the filling hole 3, are so chosen that the impinging portion of the coal stream will be deflected symmetrically in direction laterally of the member 2 (see the arrows in FIG. 2). However, there must be no significant interference with the flow of the coal stream through the hole 3.

In the illustrated embodiment the member 2 is of two parts (see FIG. 2) which are connected to the rod 1 by suitable brackets 8; its impinged surface (see FIG. 1) has upwardly inclined convex curvatures which are directed towards the respective chamber ends, so that the impinging portion of the coal stream will be deflected towards these chamber ends, as indicated by the arrows in FIG. 2. The thus deflected coal will flow towards the chamber ends due to the improved flow characteristics of preheated coal, filling the chamber 7 at those ends while the center of the chamber is being filled by the non-deflected portion of the coal stream. This assures a uniform, complete filling of the chamber and since the preheated coal is self-leveling due to its flow characteristics (which in the turbulent filling conditions somewhat resemble those of a fluidized bed), the top of the charge will be substantially level (see FIG. 1) when the upper filling level is reached.

The measures described above, i.e. charging of preheated coal at a rate of 8–20 t/min and the use of the described apparatus, assure that an oven chamber may be filled through a single charging hole to the upper permissible level at substantially 100% of volumetric capacity, i.e. no portions of the chamber will remain empty or only partially filled below the upper level. This was heretofore possible—even with preheated coal—only if the chamber was filled through 2, 3 or 4 different filling holes.

The single (and sole) charging hole 3 need not absolutely be located midway between the ends of the chamber 7; it could be provided at any other location and an already existing hole could be utilized, provided that it is large enough for the admission of preheated coal at a rate of 8–20 t/min.

As shown in FIG. 3, to facilitate the expulsion of the coke the width of the coke oven chambers generally increases (usually continuously) from the pusher side E2 to the coke side E1 (i.e. the side where the finished coke is expelled from the chamber). It has been found possible to locate the single charging opening 3 adjacent one of the ends of the oven chamber, and to be particularly advantageous if this end is the end E1 located at the coke side because the greater width of the chamber at the coke side permits the use of a hole having a larger diameter than would be possible if the hole is located elsewhere along the length of the chamber. Conventionally, all charging holes of coke oven chambers have the same diameter which depends upon the smallest chamber width, since they are located near the chamber end at the pusher side, i.e. where the chamber width is smallest.

While the invention has been illustrated and described as embodied in the charging of coke oven chambers, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A method of charging a coke oven chamber, comprising the steps of advancing preheated particulate coal by a conveyor to a coke oven chamber; charging the chamber by admitting through a single charging hole in the top of the chamber a stream of the preheated particulate coal at a charging rate of substantially 8–20 t/min; intercepting only a minor fraction of the stream of coal below the charging hole; and imparting to the intercepted fraction of the stream of coal a component of movement diverting the intercepted fraction toward the respective ends of the chamber whereby, due to the flowability of the preheated coal particles and the diversion of the intercepted fraction, the chamber becomes charged to a uniform permissible filling level at substantially 100% of its volumetric capacity.

2. A method as defined in claim 1, the width of the chamber increasing in direction from one to another end of the chamber and the charging hole being located in the region of said other end; and wherein said step of charging comprises filling said chamber in direction from said other towards said one end thereof.

* * * * *